US006030580A

United States Patent [19]

Raasch et al.

[11] Patent Number: 6,030,580

[45] Date of Patent: Feb. 29, 2000

[54] METHOD OF ASEPTICALLY TRANSPORTING BULK QUANTITIES OF STERILE PRODUCTS

[75] Inventors: Jeffrey B. Raasch; Charles E. Smith, both of Cincinnati, Ohio

[73] Assignee: Enerfab, Inc., Cincinnati, Ohio

[21] Appl. No.: 08/961,822

[22] Filed: Oct. 31, 1997

[51] Int. Cl.[7] ..... A61L 2/18

[52] U.S. Cl. ..... 422/40; 422/28; 426/326; 426/333; 426/419

[58] Field of Search ..... 422/40, 28; 220/88.3, 220/562, 1.5, 1.6, 592.09, 592.2, DIG. 24; 410/2, 156, 68; 99/471; 206/213.1; 426/312, 316, 319, 327, 333, 324, 418, 419

[56] References Cited

U.S. PATENT DOCUMENTS

| | | |
|---|---|---|
| 3,678,955 | 7/1972 | Nelson . |
| 3,714,956 | 2/1973 | Nelson . |
| 3,871,824 | 3/1975 | Rechsteiner et al. . |
| 3,873,753 | 3/1975 | Nelson et al. . |
| 3,918,678 | 11/1975 | Rechsteiner et al. . |
| 3,918,942 | 11/1975 | Rechsteiner et al. . |
| 3,951,184 | 4/1976 | Rechsteiner et al. . |
| 3,998,589 | 12/1976 | Rechsteiner et al. . |
| 4,022,922 | 5/1977 | Nelson . |
| 4,047,547 | 9/1977 | Rechsteiner et al. . |
| 4,287,821 | 9/1981 | Ukai et al. . |
| 4,325,296 | 4/1982 | Ukai et al. . |
| 4,929,459 | 5/1990 | Silvestrini . |

FOREIGN PATENT DOCUMENTS

| | | |
|---|---|---|
| 0136042 | 4/1985 | European Pat. Off. . |
| 0658494 | 6/1995 | European Pat. Off. . |

*Primary Examiner*—Elizabeth McKane
*Attorney, Agent, or Firm*—Dinsmore & Shohl LLP

[57] ABSTRACT

Methods of aseptically transporting a bulk quantity of a sterile product such as an edible food product comprise sterilizing a transporting container by flooding the container with a chemical sterilant, pressurizing the sterilized container with a positive pressure inert gas atmosphere, and aseptically supplying a bulk quantity of the sterile product to the sterilized container. The pressurized container supplied with the sterile product is sealed to substantially maintain the positive pressure during transport of the container, and the container with the sterile product therein is then transported to a remote location. A transporting container for use in the present methods comprises an insulated transportable storage tank provided with a sealable atmospheric vent on an upper portion thereof, an inert gas valve provided with a microbial filter, and an aseptic inlet/outlet valve for supplying a sterile product therethrough.

23 Claims, 1 Drawing Sheet

METHOD OF ASEPTICALLY TRANSPORTING BULK QUANTITIES OF STERILE PRODUCTS

FIELD OF THE INVENTION

The present invention is directed to methods of aseptically transporting bulk quantities of sterile products, for example edible food products, over extended distances using road, rail or marine transport containers.

BACKGROUND OF THE INVENTION

In the processing of edible food products, and prior to final packaging of the products in small quantities for consumer use, it is often necessary to store large quantities of the material in bulk form and to do so under aseptic conditions in order to ensure the ultimate purity of the food product as applied to the consumer. It is often necessary that the materials remain in storage tanks for extended periods of time, often exceeding three or more months. Accordingly, it is important to avoid the introduction of any microorganisms into storage tanks for such products as microorganism contaminants, even if admitted into the tank in only small quantities, will eventually contaminate the entire storage tank contents. Additionally, depending on the type of food product which is stored, it is often necessary to maintain the stored material at a constant temperature. For example, when the food product has been previously partially or fully processed to a desired intermediate or final condition, for example the food product has been pasteurized and a change of its temperature during storage will adversely affect the condition, it is important that the aseptic storage facility does not adversely affect the food product temperature.

Various methods and apparatus have been specially designed for facilitating aseptic storage of bulk quantities of sterile products such as edible food products. For example, the Rechsteiner et al U.S. Pat. Nos. 3,951,184, 3,998,589 and 4,047,547 disclose methods and apparatus for sealing, sampling and filling aseptic storage tanks. The Nelson U.S. Pat. No. 3,678,955 further discloses an aseptic storage and valving system for facilitating storage of edible bulk materials. The Rechsteiner et al U.S. Pat. Nos. 3,871,824; 3,918,678 and 3,918,942 also disclose aseptic valves and filters for use in connection with bulk storage containers for aseptically maintaining edible food products.

Because packaging facilities for bulk food products are often remote from the storage locations for bulk food products, it is often necessary to transport the food products over extended distances to one or more packaging facilities. Road, rail and/or marine transport may be necessary. For aseptic products, it has been difficult in the past to maintain aseptic conditions of the bulk quantities of food products during transport over extended distances owing to the difficulties of preventing microorganism contamination and the cost of providing necessary equipment to reduce the likelihood of such contamination. For example, in the past, bulk quantities of tomato products have been shipped via railroad car. However, the railroad cars required outfitting with an expensive external nitrogen supply device to maintain a positive nitrogen pressure in each railroad car at a level of approximately 1–2 psig. Additionally, the railroad cars were subjected to steam sterilization prior to introduction of the tomato products to prevent microorganism contamination therein. Accordingly, the prior systems were limited to products which did not have significant temperature sensitivity. On the other hand, edible food products such as citrus products, which generally require low storage temperatures to avoid the requirement for one or more repeated pasteurization processing steps, were not suitable for transport under these prior rail transport systems.

Accordingly, a need exists for improved and economical methods and apparatus for aseptically transporting bulk quantities of sterile products such as edible food products.

SUMMARY OF THE INVENTION

Accordingly, it is an object of the present invention to provide methods of aseptically transporting a bulk quantity of a sterile product such as an edible food product over extended distances. It is a further object of the invention to provide methods of aseptically transporting bulk quantities of edible food products over extended distances by road, rail or water, preferably by use of tank trucks, railroad tank cars and boats or ships, respectively. It is a further object of the invention to provide methods of aseptically transporting bulk quantities of edible food products which are temperature sensitive. It is a still further object of the invention to provide such methods for aseptically transporting bulk quantities of sterile products such as edible food products over extended distances and for extended periods of time in an economical manner. It is yet a further object of the invention to provide apparatus, including tank trucks and the like, suitable for use in such methods.

These and additional objects of the invention are provided by the present methods of aseptically transporting a bulk quantity of a sterile product such as an edible food product. The present methods comprise sterilizing a transporting container by flooding the container with a chemical sterilant, pressurizing the sterilized container with a positive pressure inert gas atmosphere, aseptically supplying a bulk quantity of a sterile product such as an edible food product to the sterilized container, sealing the pressurized container supplied with the sterile product to substantially maintain a positive pressure therein during transport of the container, and transporting the container with the edible food product therein. The present methods overcome various disadvantages of the prior art and allow aseptic transport of bulk quantities of edible food products and other sterile products in an efficient and economic manner.

These and additional objects and advantages provided by the present invention will be more fully understood and apparent in view of the following detailed description.

BRIEF DESCRIPTION OF THE DRAWING

The detailed description will be more readily understood when viewed in connection with the drawing in which.

DETAILED DESCRIPTION

Figure 1:
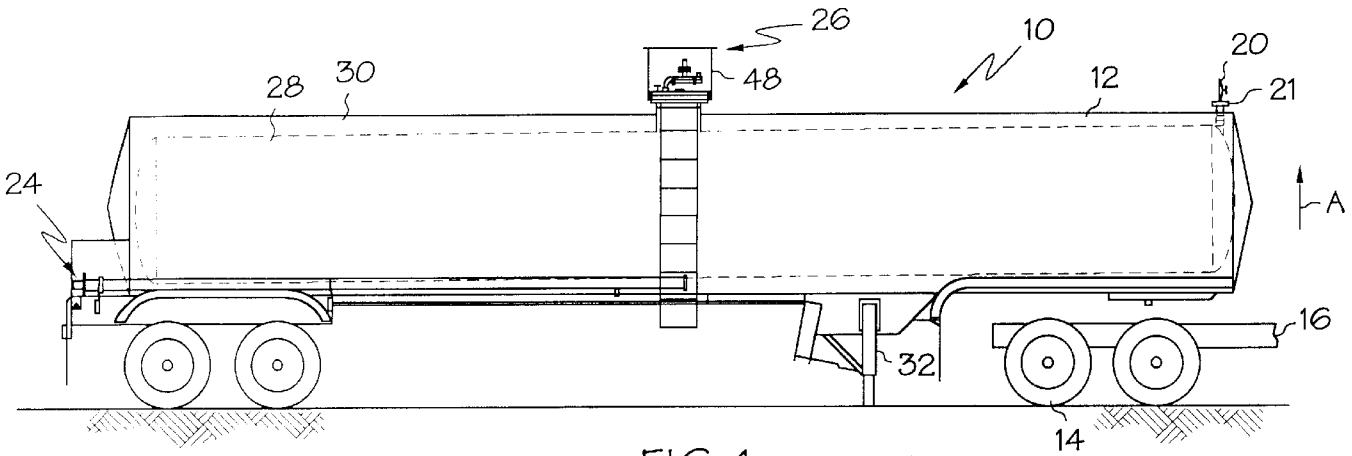
FIG. 1 is a schematic diagram of a tank truck suitable for use in the methods of the present invention.

The present invention is directed to methods of aseptically transporting bulk quantities of sterile products, particularly over extended distances. The products may be transported by road via tank truck, by rail via railway cars and/or by water via boat or ship or other appropriate marine-worthy tanks. While the present methods are in one embodiment envisioned for aseptic transport of edible food products, other sterile products such as pharmaceuticals or the like may also be transported according to the present methods. Although various food products may desirably be transported aseptically, the methods are particularly useful for transporting fruit and fruit-based products including puree, regular, concentrated or reconstituted juices, sauces or the like. The present methods are suitable for aseptically transporting citrus fruit products including citrus fruit juices which are typically maintained at temperatures below ambient. For example, the present methods may be used to aseptically transport pasteurized orange juice at temperatures less than about 50° F. (about 10° C.), and even less than about 40° F. (about 5° C.).

The present methods comprise the basic steps of sterilizing the transporting container by flooding the container with a chemical sterilant, pressurizing the sterilized container with a positive pressure inert gas atmosphere, aseptically supplying a bulk quantity of a sterile product such as an edible food product to the sterilized container, sealing the pressurized container supplied with the sterile product to substantially maintain a positive pressure therein during transport of the container, and transporting the container with the sterile product therein. The present methods are advantageous in at least two important aspects which provide significant advantages over previously-attempted methods of aseptic transport and allow efficient and economic aseptic transport of bulk quantities of sterile products such as edible food products. First, because the present methods require sterilization of the transporting container by flooding the container with a chemical sterilant, not only is microorganism contamination avoided, temperature-sensitive products may be transported. In contrast, in conventional methods which employed steam sterilization of transporting containers for tomato transport, food products which are temperature sensitive, and particularly are disadvantageously effected by high container temperatures resulting from steam sterilization, could not be aseptically transported. However, the present inventors have devised a method for conveniently sterilizing transporting containers by flooding the containers with a chemical sterilant, thereby avoiding the disadvantages associated with steam sterilization. Second, the filled container is provided with a positive pressure inert gas atmosphere and is then sealed prior to transport. As a result, oxygen is excluded from the container all during transport without the need for expensive external nitrogen cycling apparatus which was typically employed in conventional methods.

More particularly, in preferred methods according to the present invention, the sterilizing step comprises venting the transporting container to the atmosphere, flooding the interior of the transporting container and the vent with the chemical sterilant so that all air is expelled from the interior of the transporting container and the vent, sealing the vent and removing the chemical sterilant from the transporting container. The positive pressure inert gas atmosphere is provided in the sterilized container simultaneous with removal of the chemical sterilant from the container to avoid the creation of a vacuum within the transporting container.

This embodiment of the method according to the present invention is further illustrated with reference to FIG. 1. FIG. 1 sets forth schematically a tank trailer for use with a tank truck for aseptically transporting a bulk quantity of a sterile product over the road. With reference to FIG. 1, the transporting container is indicated generally at 10 and comprises a tank 12 supported on and movable by a series of wheels 14. The transporting container 10 is adapted for connection at 16 with a truck cab in a conventional manner. For use in the present methods, the transporting container is provided with one or more vents 20, an aseptic tank valve system 24 shown in greater detail in FIG. 2 and an aseptic manway 26 shown in greater detail in FIG. 3. As further illustrated schematically in FIG. 1, the tank 12 preferably comprises a storage tank 28 which is substantially entirely insulated on its outer surface with a conventional insulating material 30, whereby the contents of the storage tank are maintained at a constant temperature.

Thus, in order to affect the sterilizing step of the present methods, the transporting container 12 is vented to the atmosphere through one or more of the vents 20. The one or more vents are advantageously located in an uppermost portion of the transporting container and optionally, the transporting container may be further positioned so that the vent is elevated with respect to the remaining portion of the transporting container in order to facilitate removal of all air from the interior of the transporting container during the sterilization step. In this regard, the transporting container 10 set forth in FIG. 1 includes elevating means 32, for example in the form of a hydraulic cylinder or the like, to elevate the vented end of the transporting container in the direction of arrow A.

The interior of the transporting container is flooded with the chemical sterilant while the transporting container is vented such that all air is expelled from the interior of the transporting container and the vent. The chemical sterilant is in fluid form and may comprise either a liquid or a gas, or a mixture thereof. Preferably, the sterilant is expelled through the vent itself so that the vent may also be flooded with the chemical sterilant in order to ensure that there is no microorganism contamination of the transporting container through the vent. The vent may therefore be provided with a flood ring, shown schematically at 21 in FIG. 1, which collects any liquid sterilant expelled through the vent 20. The vent may also be provided with any suitable additional means to collect gaseous sterilant expelled through the vent if desired. Such apparatus is known and available in the art. Once the interior of the transporting container and the vent have been flooded with the chemical sterilant, the vent is sealed. Additionally, any other inlet or outlet to the transporting container, other than that through which the sterilant is drained, are sealed. The chemical sterilant is then removed from the transporting container.

Any fluid chemical sterilant in liquid or gas form may be used to flood the transporting container in accordance with the methods of the present invention. For aseptically transporting bulk quantities of edible food products, the chemical sterilant which is employed is advantageously an FDA-approved chemical sterilant for use with food products. In this regard, a particularly advantageous chemical sterilant comprises an aqueous solution of an iodophor compound. Generally, iodophors comprise any carrier of iodine and typically comprise a complex of iodine with surface active agents. A typical iodophor containing sterilant which is commercially available comprises approximately 15.5% of an active butoxpolyprotoxy, polyethoxy, ethanol-iodine complex, providing 1.75% titratable iodine, approximately 6.5% phosphoric acid and approximately 78% of an inert liquid carrier. Such a sterilant is typically combined with water in an amount sufficient to form a liquid chemical sterilant aqueous solution comprising about 20–50 ppm of iodine and suitable for use to flood the transporting container in accordance with the methods of the present invention. The iodophor solution preferably has an acidic pH, for example, in the range of from about 3 to about 4. Other liquid and gaseous chemical sterilants suitable for use in the present invention are well known in the art. A suitable chemical sterilant which may be used in gaseous form comprises chlorine dioxide. Typically, the chemical sterilant is employed at ambient temperature although the use of sterilants at less than ambient temperatures may be advantageous, but not required, when temperature-sensitive products are to be transported. If an aqueous solution of a chemical sterilant such as iodophor is employed, care should be exercised to maintain the sterilant in solution at less than ambient temperatures. Accordingly, lower temperatures may be employed as long as the iodine-containing compound or complex, or other sterilant, remains in solution. Similarly, with gaseous sterilants, lower temperatures may be employed as long as the lower temperatures do not result in condensation of the gaseous sterilant.

In a preferred embodiment, the transporting container is first cleaned before the sterilant is used to flood the container. For example, a heated caustic solution containing chlorine or other cleaning agent is circulated through the transporting container, followed by a water rinse and an acidified water rinse, for example at an acid pH in the range of about 3 to 4.

Figure 2:
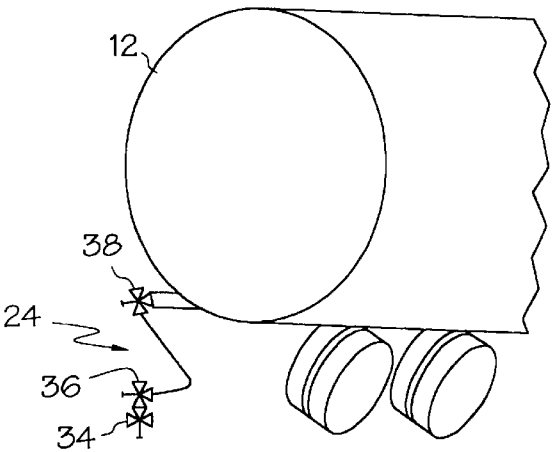
FIG. 2 is a schematic top view of one embodiment of a manway suitable for use on a tank truck which may be employed in the methods of the present invention.
Figure 3:
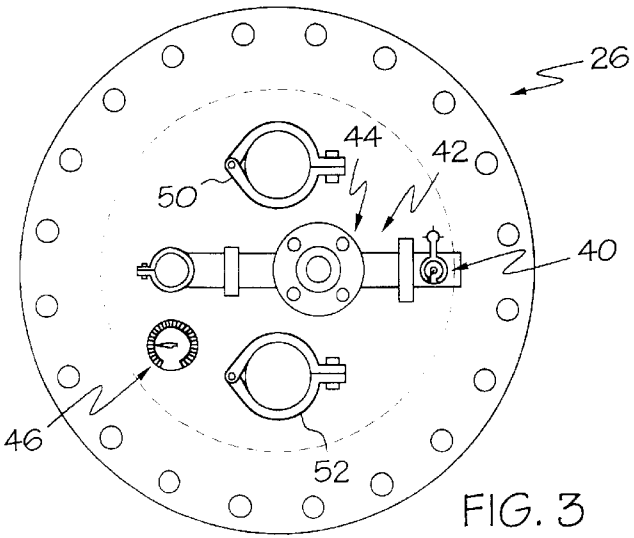
FIG. 3 is a schematic view of the location of an aseptic valving system on a tank truck for use in an embodiment of the methods of the present invention.

FIG. 2 sets forth one embodiment of piping and valve arrangement suitable for use in sterilizing a transporting container according to the methods of the present invention. Specifically, the aseptic valve system 24 includes valves 34 and 36 as inlets for one or more of cleaning solutions, chemical sterilants and the sterile product which is to be transported in bulk quantities, suitable for connection with an aseptic tank valve 38. Suitable aseptic valves and connections for use at 34 and 36 and as an aseptic tank valve 38 are set forth in the Rechsteiner et al U.S. Pat. Nos. 3,918,678, 3,871,824 and 3,951,184 and the Nelson U.S. Pat. No. 3,678,955, all of which are incorporated herein by reference. Preferably, all of the valves and connections 34, 36 and 38 are cleaned and sterilized prior to introduction of the sterile product into the transporting container.

Once the transporting container is sterilized, and the sterilized container is pressurized with a positive pressure inert gas atmosphere, a bulk quantity of a sterile product, for example an edible food product, is aseptically supplied to the container. In a preferred embodiment, as the chemical sterilant is removed from the transporting container, the positive pressure inert gas atmosphere is provided to the container in order to prevent the creation of a vacuum therein.

The inert gas may comprise any non-oxygen containing gas which does not interact with the sterile product or encourage microorganism growth therein. In a preferred embodiment, the inert gas comprises a nitrogen atmosphere which is free of oxygen. The inert gas atmosphere of positive pressure should be sufficient in order to maintain a positive pressure throughout transport and preferably to assist in expelling the sterile product from the transporting container once the container has reached its destination. Generally, the inert gas positive pressure is greater than about 2 psig and therefore greater than the pressures conventionally employed in rail transport cars wherein an external nitrogen source was provided on each rail car to continuously cycle and maintain a positive pressure therein. In a more preferred embodiment, the inert gas positive pressure is greater than about 4 psig and preferably is about 5 psig or more.

In the embodiment discussed above wherein the positive pressure inert gas atmosphere is provided to the sterilized container simultaneous with the removal of the chemical sterilant, in order to avoid creation of a vacuum in the transmitting container, the inert gas may then be aseptically vented from the container when the bulk quantity of sterile product is supplied to the pressurized sterilized container. The inert gas may be vented through the vent used during the sterilization step, i.e., vent 20 in FIG. 1, provided that such vent includes means for maintaining the aseptic condition of the transporting container during any such venting process, or a further aseptic vent means may be employed. In the embodiment set forth in FIG. 1, manway 26 is provided with additional aseptic vent means. More specifically, with reference to FIG. 3, the manway 26 is provided with a quick connect/disconnect inert gas (nitrogen) supply valve 40, a microbial filter 42 and a pressure/vacuum relief valve 44. A suitable embodiment of the microbial filter 42 is set forth in the Rechsteiner et al U.S. Pat. No. 3,918,942, which is incorporated herein by reference. The manway may further include one or more pressure gauges 46 which facilitate monitoring of the internal pressure within the transporting container throughout transit. The entire manway may be flooded through ports 50, 52 during the sterilization step, and preferably the manway is provided with a flood ring 48 wherein liquid sterilant expelled through the ports may be collected. While the manway is flooded with chemical sterilant, for example when liquid sterilant is contained within the flood ring 48, the ports 50 and 52 are closed. Simultaneously or in a separate step, connections 40, 42 and 44 are sterilized and sealed so that the sterilized environment of the transporting container is maintained.

The methods according to the present invention are particularly suitable for transporting edible food products from an aseptic storage facility to another aseptic storage facility, a packaging location or the like while maintaining the aseptic conditions of the product. Thus, the present methods may be used to transport citrus juice, specifically orange juice, to a remote aseptic storage facility, a remote packaging facility or the like, while maintaining the aseptic condition of the juice. As a result, no further pasteurization of the juice is required once it has reached its remote destination. The methods of the present invention may be used to transport edible food products aseptically over distances of hundreds or even thousands of miles in time periods of from several hours to several days or even several weeks.

Once the bulk quantity of sterile product is aseptically supplied to the container and the container is pressurized with a positive pressure of inert gas atmosphere, the pressurized container supplied with the sterile product is sealed to substantially maintain the positive pressure during transport of the container. The present inventors have discovered that providing the positive pressure followed by sealing the container allows aseptic transport of the bulk quantity of product in the absence of a costly continuously-cycling inert gas supply means as have been employed in the prior art.

When the transporting container is received at a remote location, the sterile product is removed from the transporting container using similar aseptic valves and connections to remove the product and deliver it to another storage container, a packaging facility or the like in its aseptic condition.

The specific embodiments of the present invention discussed herein are provided to illustrate various embodiments of the invention and are not intended to be limiting thereof. Additional embodiments and advantages within the scope of the present invention will be apparent to one of ordinary skill in the art.

We claim:

1. A method of aseptically transporting a bulk quantity of an edible citrus fruit product, comprising (a) sterilizing a transportable container by flooding the container with a chemical sterilant, (b) pressurizing the sterilized container with a positive pressure inert gas atmosphere, (c) aseptically supplying a bulk quantity of an edible citrus fruit product to the sterilized container, (d) sealing the pressurized container supplied with the edible citrus fruit product to substantially maintain a positive pressure during transport of the container, and (e) transporting the sealed and pressurized container with the edible citrus fruit product therein.

2. A method according to claim 1, wherein the edible food product comprises citrus juice.

3. A method according to claim 1, wherein the transportable container comprises a tank truck.

4. A method according to claim 1, wherein the transportable container comprises a marine tank.

5. A method according to claim 1, wherein the sterilant is in liquid form.

6. A method according to claim 5, wherein the sterilant comprises an aqueous solution of an iodine-containing compound.

7. A method according to claim 1, wherein the sterilant is in gaseous form.

8. A method according to claim 1, wherein the inert gas comprises nitrogen.

9. A method according to claim 1, wherein the inert gas positive pressure is greater than about 2 psig.

10. A method according to claim 9, wherein the inert gas positive pressure is greater than about 4 psig.

11. A method according to claim 10, wherein the inert gas positive pressure is about 5 psig.

12. A method according to claim 1, wherein the sterilizing step comprises venting the interior of the transportable container through a vent to the atmosphere, flooding the interior of the transportable container and the vent with the chemical sterilant so that all air is expelled from the interior of the transportable container and the vent, sealing the vent, and removing the chemical sterilant from the transportable container.

13. A method according to claim 12, wherein the chemical sterilant comprises an aqueous solution of iodophor.

14. A method according to claim 12, wherein the chemical sterilant is removed from the sterilized container by draining, and the sterilized container is provided with the positive pressure inert gas atmosphere simultaneous with removal of the chemical sterilant.

15. A method according to claim 14, wherein the bulk quantity of an edible food product is aseptically supplied to the pressurized sterilized container while inert gas is aseptically vented from the container.

16. A method according to claim 1, wherein the edible food product is transported at a temperature less than ambient.

17. A method according to claim 16, wherein the edible food product is transported at a temperature less than about 50° F.

18. A method according to claim 16, wherein the edible food product is transported at a temperature less than about 40° F.

19. A method of aseptically transporting a bulk quantity of an edible fruit-based food product, comprising (a) sterilizing a transportable container by venting the interior of the transportable container through a vent to the atmosphere, flooding the interior of the transportable container and the vent with a chemical sterilant so that all air is expelled from the interior of the transportable container and the vent, sealing the vent, and removing the chemical sterilant from the transportable container, (b) pressurizing the sterilized container with a positive pressure inert gas atmosphere, (c) aseptically supplying a bulk quantity of an edible fruit-based food product to the sterilized container, (d) sealing the pressurized container supplied with the edible fruit-based food product to substantially maintain a positive pressure during transport of the container, and (e) transporting the sealed and pressurized container with the edible fruit-based food product therein.

20. A method according to claim 19, wherein the container is insulated and the edible fruit-based food product is aseptically supplied and transported at a temperature less than ambient.

21. A method according to claim 20, wherein the edible food product comprises citrus juice.

22. A method according to claim 19, wherein the container is insulated and the edible fruit-based food product is aseptically supplied and transported at a temperature less than about 50° F.

23. A method according to claim 19, wherein the container is insulated and the edible fruit-based food product is aseptically supplied and transported at a temperature less than about 40° F.

* * * * *